US006164875A

United States Patent [19]

Wu et al.

[11] Patent Number: 6,164,875

[45] Date of Patent: Dec. 26, 2000

[54] TRENCH SHIELD DIRECTLY RIDABLE AND MOVABLE ON A CONSTRUCTING PIPE

[75] Inventors: Shih-Hsiung Wu; Chen-Chung Lin, both of Taipei; Cheng-Yang Hsu, Taipei Hsien, all of Taiwan

[73] Assignee: Institute of Occupational Safety and Health, Council of Labor Affairs, Taipei, Taiwan

[21] Appl. No.: 09/290,871

[22] Filed: Apr. 14, 1999

[51] Int. Cl.[7] ..... E02D 3/02; E02D 5/00

[52] U.S. Cl. ..... 405/283; 405/272; 405/282; 405/157

[58] Field of Search ..... 405/282, 283, 405/272, 154, 157

[56] References Cited

U.S. PATENT DOCUMENTS

| | | | |
|---|---|---|---|
| 2,738,745 | 3/1956 | Harpold | 405/157 |
| 3,664,141 | 5/1972 | Wyatt | 405/174 |
| 3,788,086 | 1/1974 | West, Jr. | 405/283 |
| 3,820,345 | 6/1974 | Brecht | 405/283 |
| 3,831,388 | 8/1974 | Wells | 405/157 |
| 3,936,961 | 2/1976 | Gahler | 405/283 X |
| 4,044,565 | 8/1977 | Stuckman | 405/283 |
| 4,059,965 | 11/1977 | Stuckman | 405/154 |
| 5,306,103 | 4/1994 | Spencer | 405/282 |
| 5,336,023 | 8/1994 | Burdine | 405/283 |
| 5,865,567 | 2/1999 | Wilkinson | 405/283 |

*Primary Examiner*—Eileen D. Lillis
*Assistant Examiner*—Jong-Suk Lee
*Attorney, Agent, or Firm*—Dougherty & Troxell

[57] ABSTRACT

A trench shield includes a pair of shielding panels for protecting opposite side walls of a trench excavation, two side frames are provided for respectively adjustably securing the two shielding panels on the two side frames, and have a plurality of brace members spaced between the two side frames for retaining the two side frames and the two shielding panels, and two rolling devices respectively are mounted on a front bottom portion and a rear bottom portion of the trench shield for carrying the trench shield to be ridable and movable on a pipe under construction in the trench excavation. Upon rolling of the rolling devices on the constructing pipe, the trench shield will be conveniently moved on the pipe without any obstruction.

9 Claims, 4 Drawing Sheets

TRENCH SHIELD DIRECTLY RIDABLE AND MOVABLE ON A CONSTRUCTING PIPE

BACKGROUND OF THE INVENTION

Many conventional trench shields had been disclosed for protecting side walls of a trench excavation against collapse. However, they are complex in structure and not mobile in the trench, thereby being inconvenient for use in a construction site especially in a pipe construction work.

U.S. Pat. No. 5,306,103 (hereinafter called as "prior art") to Spencer disclosed a wheeled carriage assembly for trench shield having protective panels (18) hung on an axle members (30) of a plurality of wheels (52) which are rolling on a ground surface (22) adjacent the trench. Such a wheeled carriage assembly may suspend and support a trench shield for advancement along an excavated trench such as for laying a pipe (16) in the trench.

However, the ground surface near the trench excavation may always be placed or piled with excavated materials, soil and stones to become an uneven ground surface, easily obstructing the forward movement of the conventional wheeled carriage assembly (prior art) and thereby decreasing the efficiency of an engineering construction work.

The present inventors have found the drawbacks of the prior art and invented the present trench shield directly ridable and movable on a constructing pipe.

SUMMARY OF THE INVENTION

The object of the present invention is to provide a trench shield including: a pair of shielding panels for protecting opposite side walls of a trench excavation; two side frames provided for respectively adjustably securing the two shielding panels on said two side frames, having a plurality of brace members spaced between the two side frames for retaining the two side frames and the two shielding panels; and two rolling devices respectively mounted on a front bottom portion and a rear bottom portion of the trench shield for carrying the trench shield to be ridable and movable on a pipe under construction in the trench excavation; whereby upon rolling of the rolling devices on the constructing pipe, the trench shield will be conveniently moved on the pipe without any obstruction.

DETAILED DESCRIPTION

Figure 1:
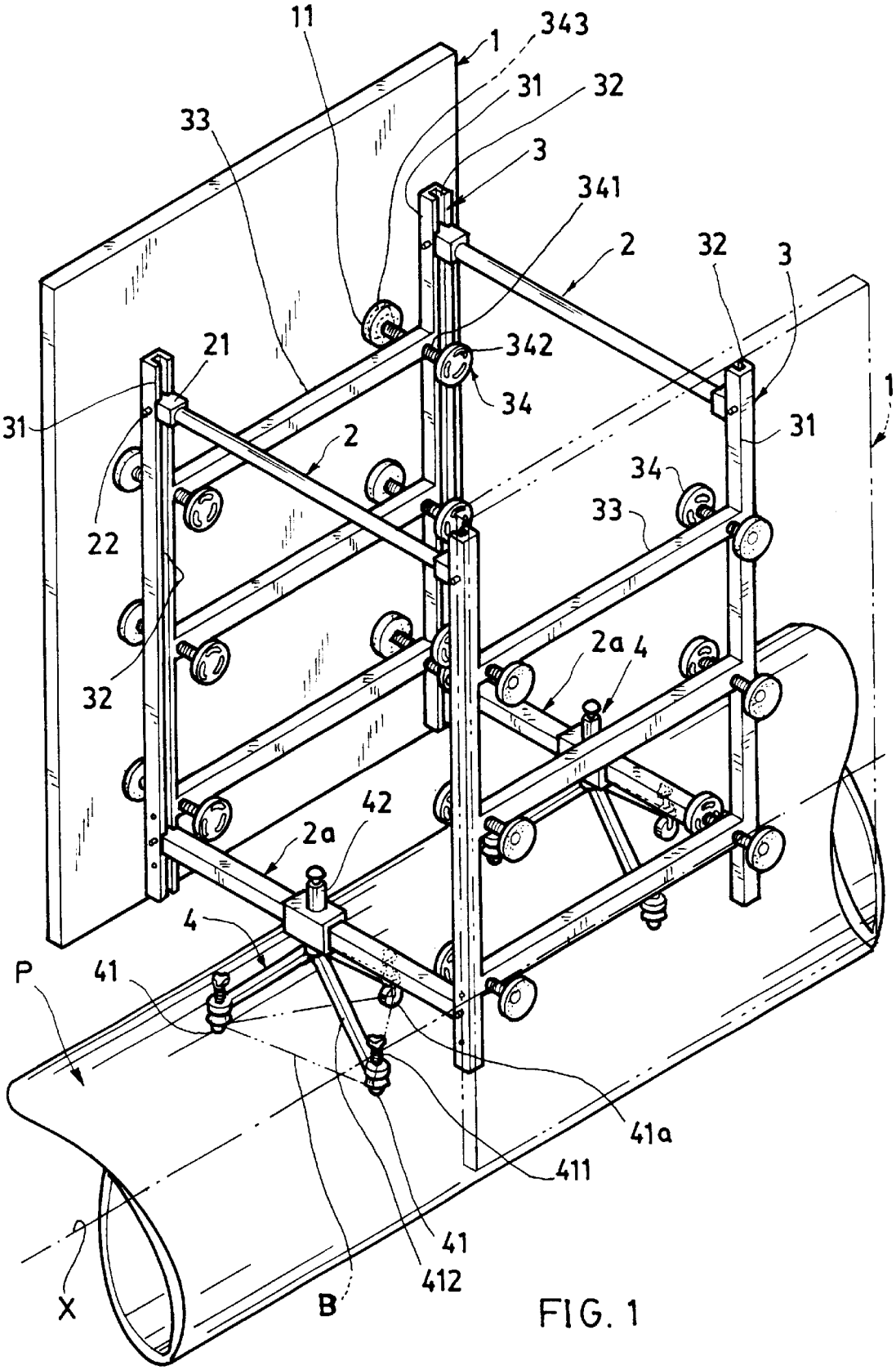
FIG. 1 is a perspective view of the present invention.

As shown in the drawing figures, the trench shield of the present invention comprises: a pair of shielding panels or plates 1, a plurality of brace members 2, 2*a* retaining two side frames 3 with each brace member 2, 2*a* transversely spaced between the two side frames 3, and two rolling means 4 respectively secured to a front and a rear bottom portion of the trench shield and ridable on a constructing pipe P as laid in a trench excavation T.

Each brace member 2 has two terminal blocks 21 formed on opposite ends of the brace member 2, with each terminal block 21 slidable and lockable on the side frame 3 by a locking screw 22. The bottom (or lowest) brace member having a numeral of "2*a*" is installed on a bottom portion of each side frame 3 for mounting the rolling means 4 on the bottom brace member 2*a*.

Each brace member 2, 2*a* may also be made as telescopically adjustable for varying its length in order to be properly retained and spaced between the two side frames 3.

Figure 2:
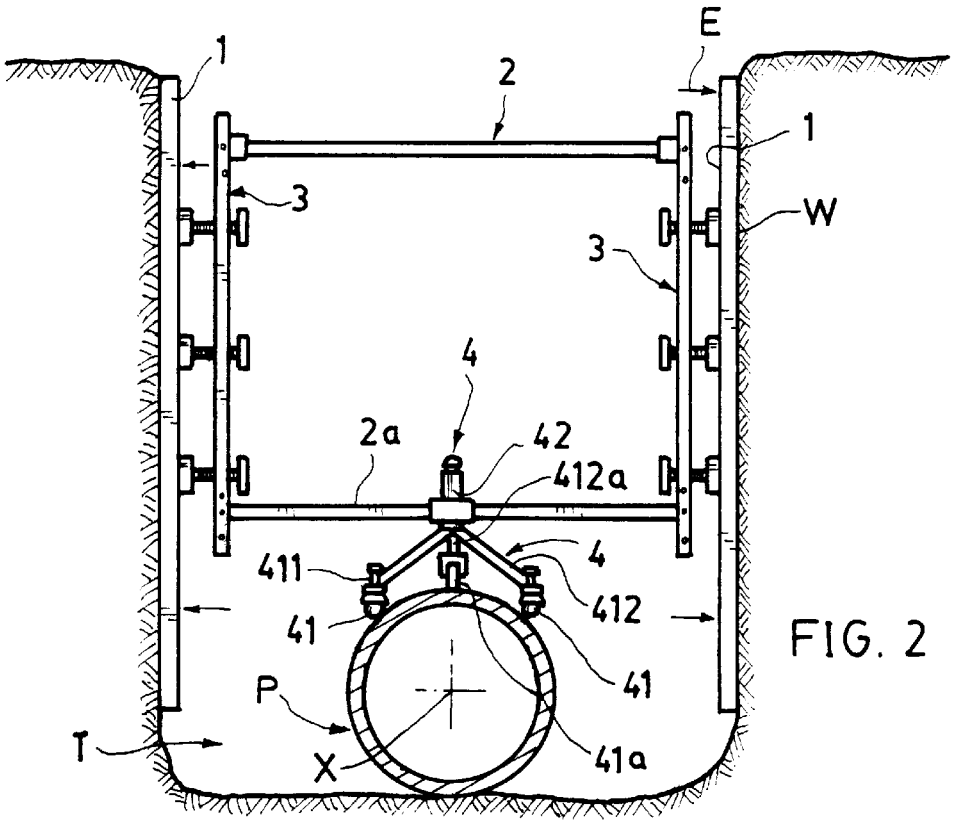
FIG. 2 is a partial cross sectional drawing of the present invention when provided for shielding the side walls of a trench excavation.
Figure 3:
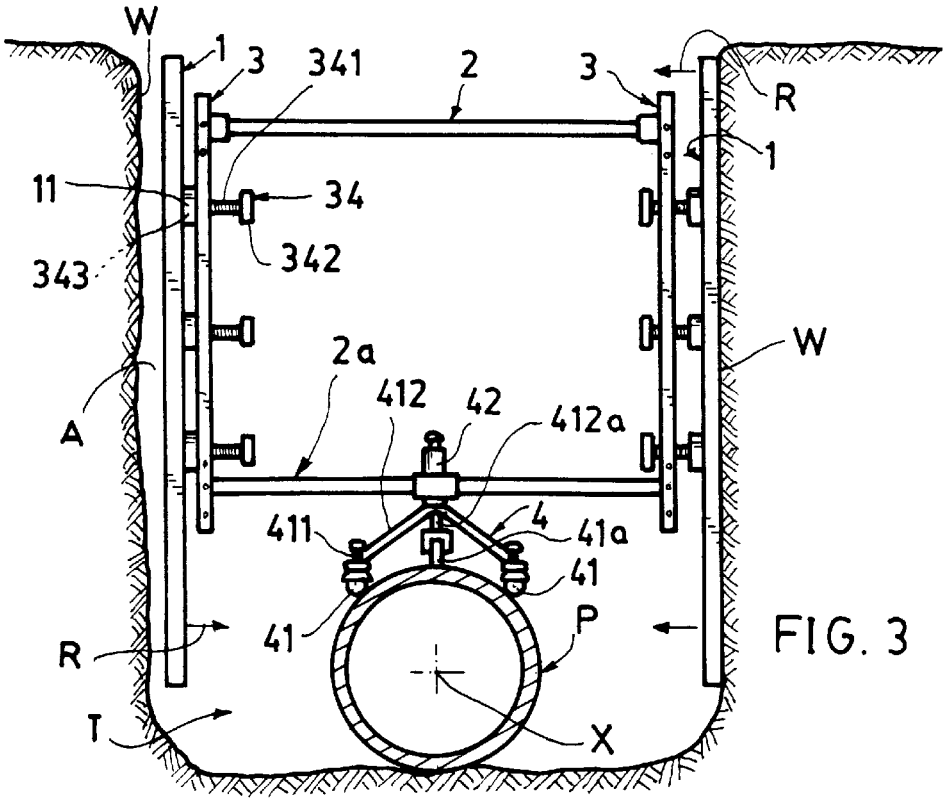
FIG. 3 is an illustration when inwardly retracting the shielding panel of the present invention in order for moving the trench shield.

Each side frame 3 includes: a front and a rear column member 31 having a plurality of links 33 transversely connecting the front and the rear column members 31, each column member 31 vertically formed with a longitudinal groove 32 lengthwise in the column member 31 to be slidably engageable with each terminal block 21 of the brace member 2, 2*a* for adjusting the height of the brace member on the side frames 3; and a plurality of adjusting means 34 rotatably mounted on the side frame 3 or rotatably mounted on the links 33 of the side frame 3, each adjusting means 34 connectable with each shielding panel 1 for driving the shielding panel outwardly (E) towards a side wall W of the trench excavation T for shielding the trench wall W (FIG. 2), or for retracting (R) the shielding panel 1 from the side wall W of the trench excavation for moving the trench shield within the trench excavation (FIG. 3).

Each adjusting means 34 includes: a bolt 341 rotatably mounted on a link 33 of the side frame 3, a handle 342 secured on an inner end of the bolt 341 for rotating the bolt 341, and a coupling head portion 343 formed on an outer end of the bolt 341 to be rotatably engageable with a coupling socket 11 formed on an inside surface of the shielding panel 1; whereby upon a rotation of the handle 342 and the bolt 341 in a first direction to extend the coupling head portion 343 outwardly to thus urge the coupling socket 11 and the shielding panel 1 outwardly (E) as shown in FIG. 2, the shielding panel 1 will be outwardly urged to protect a side wall W of the trench excavation T to prevent a collapse; and upon a rotation of the handle 342 and the bolt 341 in a second or counter direction to retract the coupling head portion 343 and the coupling socket 11 of the panel 1, the panel 1 will be retracted (R) as shown in FIG. 3 to form an aperture A between the side wall W and the panel 1, allowing a movement of the trench shield in the excavation T.

Figure 6:
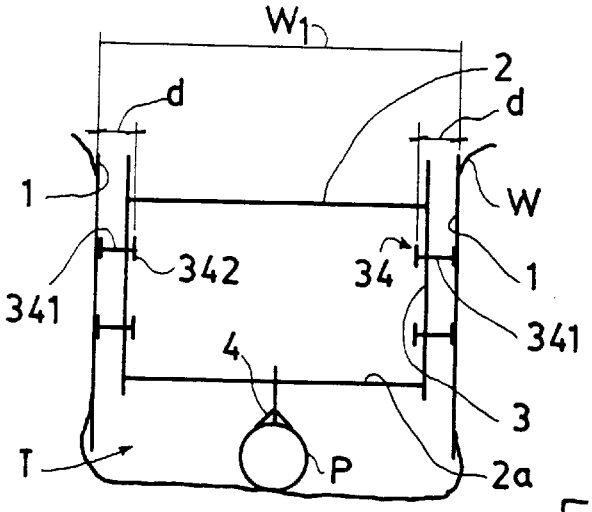
FIG. 6 shows a wider adjustment of the two panels of the present invention.
Figure 7:
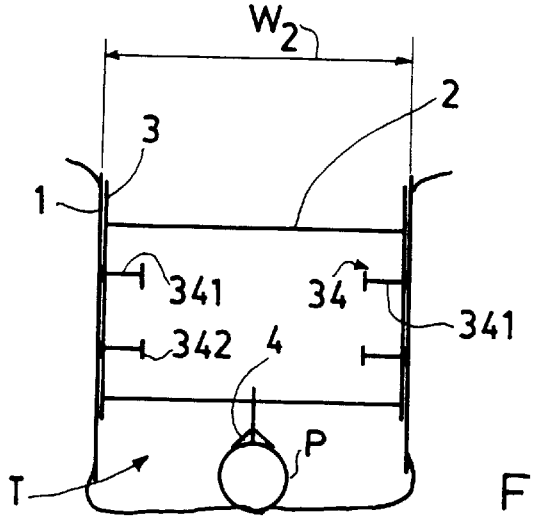
FIG. 7 shows a narrow adjustment in comparison with that of FIG. 6.

Upon rotation of the adjusting means 34 provided on opposite side frames 3, the two panels 1 may be extended either outwardly or be retracted inwardly for adjusting the spacing between the two panels 1 in commensuration with a width between opposite side walls W of the trench excavation T. The adjustment distance as effected on each side frame 3 depends upon the stroke of each bolt 341 of the adjusting means 34. So, the maximum adjustment distance "d" of each bolt 341 is generally equal to the length of the bolt 341. As shown in FIG. 6, the width W1 between the two panels 1 are the maximum widths as obtained by extending the bolts 341 outwardly to their utmost outward limits. Comparatively, if the bolts 341 are retracted inwardly to their utmost inward limits as shown in FIG. 7, the width W2 as spaced between the two panels 1 will be the minimum in contrast to that as shown in FIG. 6. A simple equation is obtained as follows:

$$W1=W2+(2\times d)$$

$$W1-W2=2d$$

Figure 8:
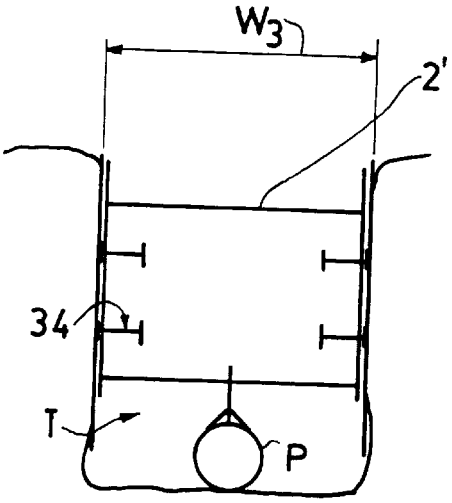
FIG. 8 shows a further narrower adjustment than that of FIG. 7.

If for further adjusting the width between the two panels 1, the brace members 2, 2*a* may be substituted with brace members of different lengths, or may be made as telescopic mechanism for adjusting the spacing between the two side frames 3 and between the two panels 1. As shown in FIG. 8, a narrower width W3 may be further obtained if the brace member is substituted with a shorter one.

Other mechanisms for adjusting the spacing between the two panels 1 or between the two side frames 3 may be modified by those skilled in the art.

Figure 4:
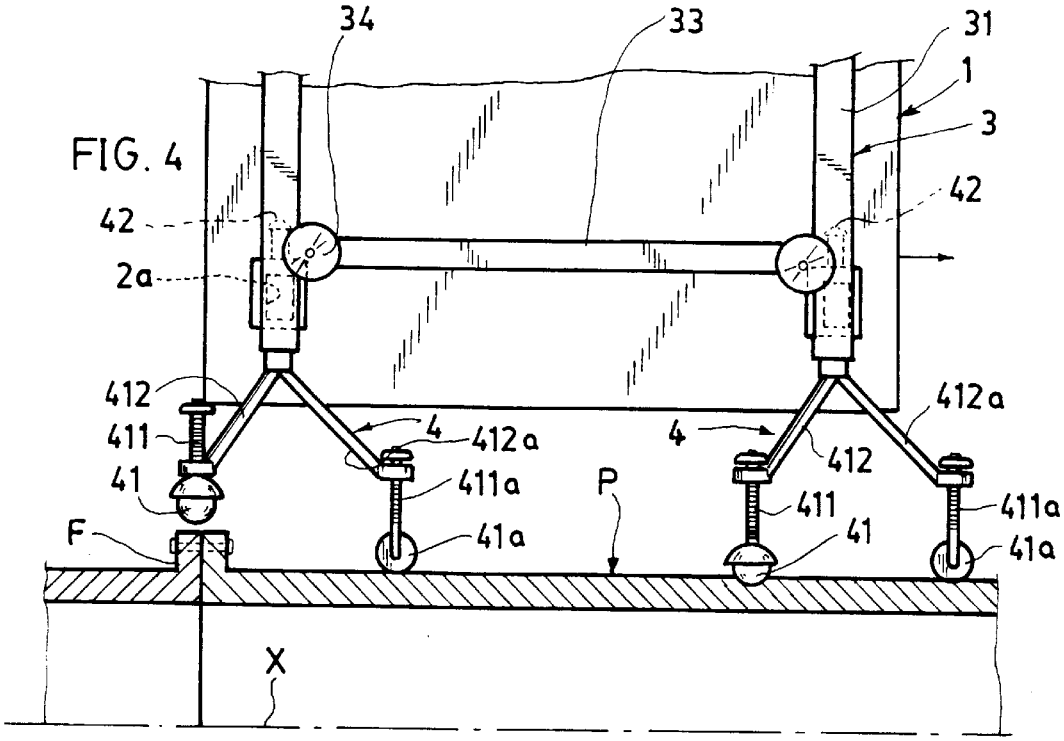
FIG. 4 is an illustration showing how the rolling device of the trench shield strides over a pipe flange in accordance with the present invention.
Figure 5:
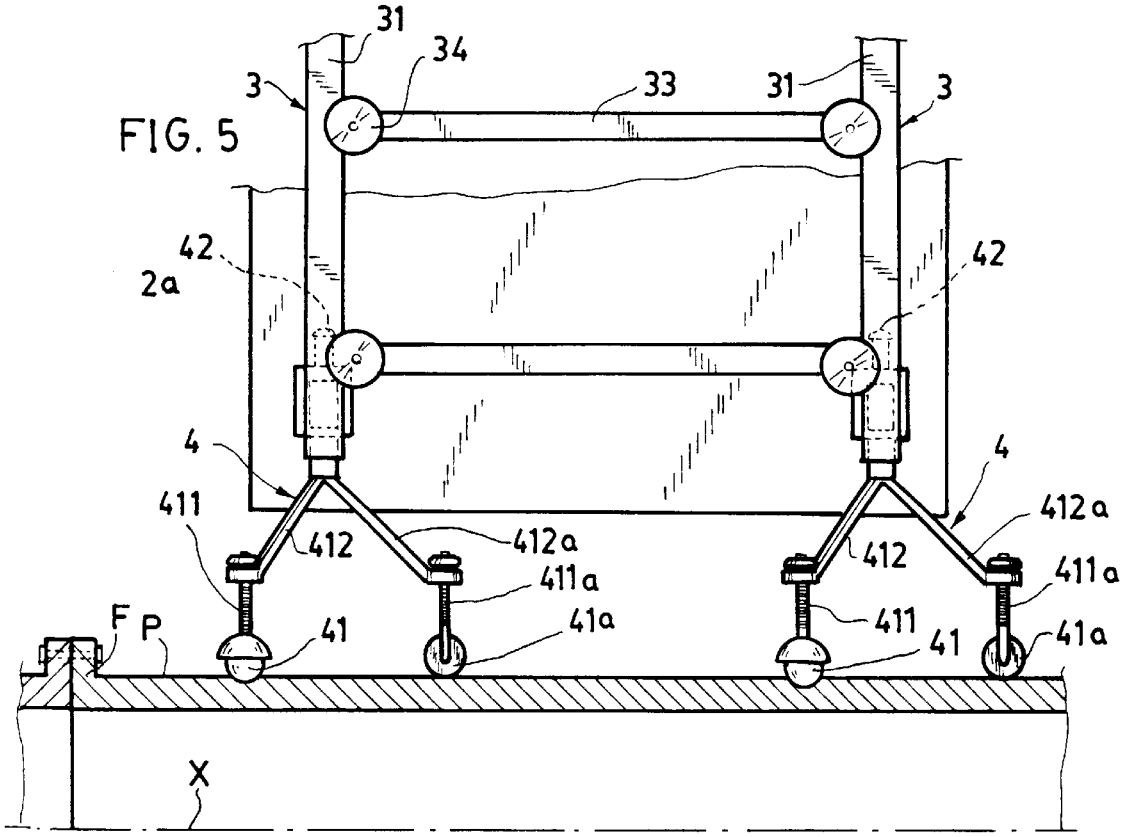
FIG. 5 is a longitudinal illustration showing the rolling of the present invention after passing over the pipe flange as shown in FIG. 4.

Each rolling means 4 includes: a pair of symmetric rollers 41 rotatably mounted on a pair of supporting legs 412 secured to a holding base 42 which is secured on a bottom brace member 2*a*, each roller 41 adjustably mounted on each supporting leg 412 by an adjusting bolt 411 for adjusting a height of the roller 41 on the leg 412 for lifting the roller 41 above a pipe flange F as shown in FIG. 4 when movably riding on the pipe P under construction within the trench excavation T; and at least an auxiliary roller 41*a* rotatably mounted on an auxiliary supporting leg 412*a* secured to the holding base 42, each auxiliary roller 41*a* adjustably mounted on the auxiliary supporting leg 412*a* by an auxiliary adjusting bolt 411*a* for adjusting a height of the auxiliary roller 41*a* on the auxiliary supporting leg 412*a* for lifting the roller 41*a* above a pipe flange F of the pipe for passing over the pipe flange F when forwardly moving the trench shield on a constructing pipe P.

The auxiliary roller 41*a* and the pair of symmetric rollers 41 may increase a polygonal or triangular base area (B) on the pipe; or may form a tripod for stably holding either a rear or a front portion of the trench shield (FIG. 1). The auxiliary roller 41*a* may be projectively aligned with a longitudinal axis X defined at a longitudinal center of the construction pipe P; and the two symmetric rollers 41 may be symmetrically disposed on opposite rear (or front) sides of the auxiliary roller 41*a* , thereby forming a "tripod" or three-leg configuration for gravitationally stably supporting the front or rear portion of the trench shield to be movably ridable on the pipe P.

Since the trench shield is movably ridable on the pipe under construction and the pipe circumferential surface is always smooth and arcuately shaped, the trench shield of the present invention can thus be conveniently moved along the pipe under construction without any obstruction.

Naturally, the constructing pipe P should have a strength durable for the load caused by the weight of the trench shield of the present invention.

If the pipe P has a larger diameter, the rolling means 4 as secured on the bottom (or lowest) brace member 2*a* may be adjusted to be a higher position by moving the brace member 2*a* upwardly on the side frames 3.

If necessarily, each column member 31 of the side frame 3 may be further connected with a supporting column (not shown) having a wheel rotatably mounted on a bottom of the supporting column so that at least four wheels can be rotatably mounted on the bottom portions of the side frames 3 to be rolling on a trench bottom, thereby helping stabilization of the trench shield as rolling on the pipe.

The "tripod" structure of the rollers 41, 41*a* of each rolling means 4 as abovementioned may also be modified to be four rollers (not shown), namely, a pair of front rollers and a pair of rear rollers to be symmetrically disposed on the pipe surface having a rectangular shape from a top view.thereof.

For simplifying the structure of the present invention such as used for constructing a pipe with smaller diameter, the rolling means 4 may also be simplified by eliminating the descending or lowering mechanism as aforementioned. Then, the complete set of trench shield can be lifted, for instance, by a crane or jack to stride or pass over a pipe flange.

Also, each roller 41, 41*a* may also be secured to a pivotal arm (not shown) which is rotatably secured to the bottom brace member 2*a*. Upon passing over a pipe flange, the pivotal arm having the rollers 41, 41*a* mounted thereon may be pivotally lifted upwardly to stride over the pipe flange. After passing over the pipe flange, the pivotal arm may then be lowered downwardly to restore the roller to be movably ridable on the pipe under construction.

Accordingly, the present invention is superior to a conventional trench shield since the trench shield can be directly climbable and rolling on a pipe under construction for a convenient movement of the trench shield within the trench excavation.

The present invention may be modified without departing from the spirit and scope of the present invention.

We claim:

1. A trench shield comprising:

a pair of shielding panels for shielding opposite side walls of a trench excavation having a pipe under construction laid in the trench excavation;

a pair of side frames as spaced and retained by a plurality of brace members between the two side frames, each said shielding panel securable with each said side frame and movably positioned outside each said side frame; and two rolling means respectively mounted to a front bottom brace member and a rear bottom brace member, each said bottom brace member transversely secured to the two side frames, each said rolling means ridable and movable on the pipe under construction in the trench excavation.

2. A trench shield according to claim 1, wherein each said brace member has two terminal blocks each slidable and lockable on each said side frame by a locking screw for adjusting a height of said brace member on said side frame.

3. A trench shield according to claim 1, wherein each said side frame includes a front column member, a rear column member, a plurality of links transversely connecting said front and said rear column members, and a plurality of adjusting means rotatably mounted on said side frame, each said adjusting means connectable with each said shielding panel; and having each said brace member transversely connected between two opposite said column members of two said side frames.

4. A trench shield according to claim 3, wherein each said column member is vertically formed with a longitudinal groove lengthwise in said column member, said longitudinal groove slidably engageable with a terminal block of said brace member for adjusting a height of said brace member on said column member of said side frame.

5. A trench shield according to claim 3, wherein each said adjusting means includes: a bolt rotatably mounted on said link of said side frame, a handle secured on an inner end of said bolt, and a coupling head portion formed on an outer end of the bolt to be rotatably engageable with a coupling socket formed on said shielding panel, whereby upon rotation of said bolt to urge said coupling head portion and said coupling socket on said panel outwardly, said panel is urged outwardly for shielding a side wall of a trench excavation.

6. A trench shield according to claim 1, wherein each said rolling means includes a pair of symmetric rollers securable to each said brace member transversely connected between said two side frames and symmetrically disposed on opposite sides of a longitudinal axis of the pipe under construction as laid in the trench excavation, and at least an auxiliary roller securable to said bottom brace member and separating from said two symmetric rollers for forming a polygonal base area as defined by said two symmetric rollers and said auxiliary roller on the pipe for helping gravitational stabilization of said rollers on the pipe under construction.

7. A trench shield according to claim 6, wherein each said roller is rotatably mounted on a supporting leg and adjustably mounted by an adjusting bolt rotatably held on the supporting leg secured to a holding base which is fixed on the bottom brace member linked on the side frames, said roller adjustably lifted on said supporting leg to be positioned at a height above a pipe flange of the pipe under construction for striding over the pipe flange when moving said rolling means on said pipe for forwarding the trench shield in the trench excavation; and said roller adjustably lowered on said supporting leg to be ridable and rolling on the pipe.

8. A trench shield according to claim 6, wherein said auxiliary roller is rotatably mounted on an auxiliary supporting leg secured to a holding base fixed on the bottom brace member to be projectively aligned with a longitudinal axis defined at a longitudinal center of the pipe under construction and forming a tripod with the pair of symmetric rollers for stably riding said rolling means on the pipe, said auxiliary roller adjustably lifted or lowered on said auxiliary supporting leg by an auxiliary adjusting bolt rotatably held on said auxiliary supporting leg.

9. A trench shield according to claim 6, wherein each said roller is pivotally secured to said bottom brace member, whereby upon passing said roller over a pipe flange of the pipe under construction, the roller is pivotally lifted upwardly to stride over the pipe flange for forwardly moving the trench shield in the trench excavation.

* * * * *